US009321266B1

(12) United States Patent
Woebkenberg et al.

(10) Patent No.: US 9,321,266 B1
(45) Date of Patent: Apr. 26, 2016

(54) JET STACK TO RESERVOIR MOAT MERGE WITH AN ADHESIVE JOINT

(71) Applicant: XEROX CORPORATION, Norwalk, CT (US)

(72) Inventors: Jason Paul Woebkenberg, Lake Oswego, OR (US); Jonathan Robert Brick, Tualatin, OR (US); Robert Mark Jacobs, Tigard, OR (US); Joseph Andrew Broderick, Portland, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/546,740

(22) Filed: Nov. 18, 2014

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1623* (2013.01); *B41J 2002/14419* (2013.01)

(58) Field of Classification Search
CPC ..... B41J 2/14
USPC ..... 347/47
See application file for complete search history.

(56) References Cited

U.S. PATENT DOCUMENTS 4,678,529 A * 7/1987 Drake et al. ..... 156/234
5,388,326 A * 2/1995 Beeson ..... B41J 2/1603 156/276
7,600,863 B2 * 10/2009 Brick ..... B41J 2/14024 347/86
8,523,334 B2 * 9/2013 Tomlin ..... B41J 2/175 347/84
2002/0101487 A1 * 8/2002 Petersen ..... B41J 2/17509 347/85
2005/0206686 A1 * 9/2005 Hirano ..... B41J 2/14209 347/68
2008/0259121 A1 * 10/2008 Stevenson ..... B41J 2/14 347/47
2009/0303288 A1 * 12/2009 Nakajima ..... B41J 2/1404 347/47

* cited by examiner

*Primary Examiner* — Alessandro Amari
*Assistant Examiner* — Michael Konczal
(74) *Attorney, Agent, or Firm* — Marger Johnson

(57) ABSTRACT

A print head has an ink reservoir to hold ink, the reservoir having protrusions, an external manifold coupled to the ink reservoir, the ink manifold having channels on a first surface that match the protrusions, and an adhesive in the channels to contact the protrusions. A method of assembling a print head includes mounting a jet stack to a flat plate of a merge fixture, dispensing adhesive on an external manifold attached to the jet stack, placing a reservoir in the merge fixture above the external manifold such that the reservoir does not contact the adhesive, attaching an upper plate to the reservoir to set a depth, pressing the reservoir into the adhesive, and curing the adhesive.

8 Claims, 5 Drawing Sheets

JET STACK TO RESERVOIR MOAT MERGE WITH AN ADHESIVE JOINT

BACKGROUND

Some inkjet printers deposit drops of ink on a print substrate through an array of holes, also referred to as nozzles. In some printers, the ink is routed from an ink reservoir to the nozzles through a series of manifolds and chambers formed by stacking multiple plates into what is sometimes called a jet stack. Some printers attach the ink reservoir to the jet stack by using gaskets around ports from the reservoir to the jet stack. These are then compressed and the jet stack is clamped the stack in place using top and bottom clips and fasteners such as screws to form a joint.

Completed print heads have a stringent flatness requirement. The flatness of this joint depends upon the quality of the incoming parts in order to meet these requirements. The incoming parts subsequently have high tolerance requirements. This increases the costs of the print head as well as the likelihood of a system failure if the tolerances are not met.

DETAILED DESCRIPTION OF THE EMBODIMENTS

Figure 1:
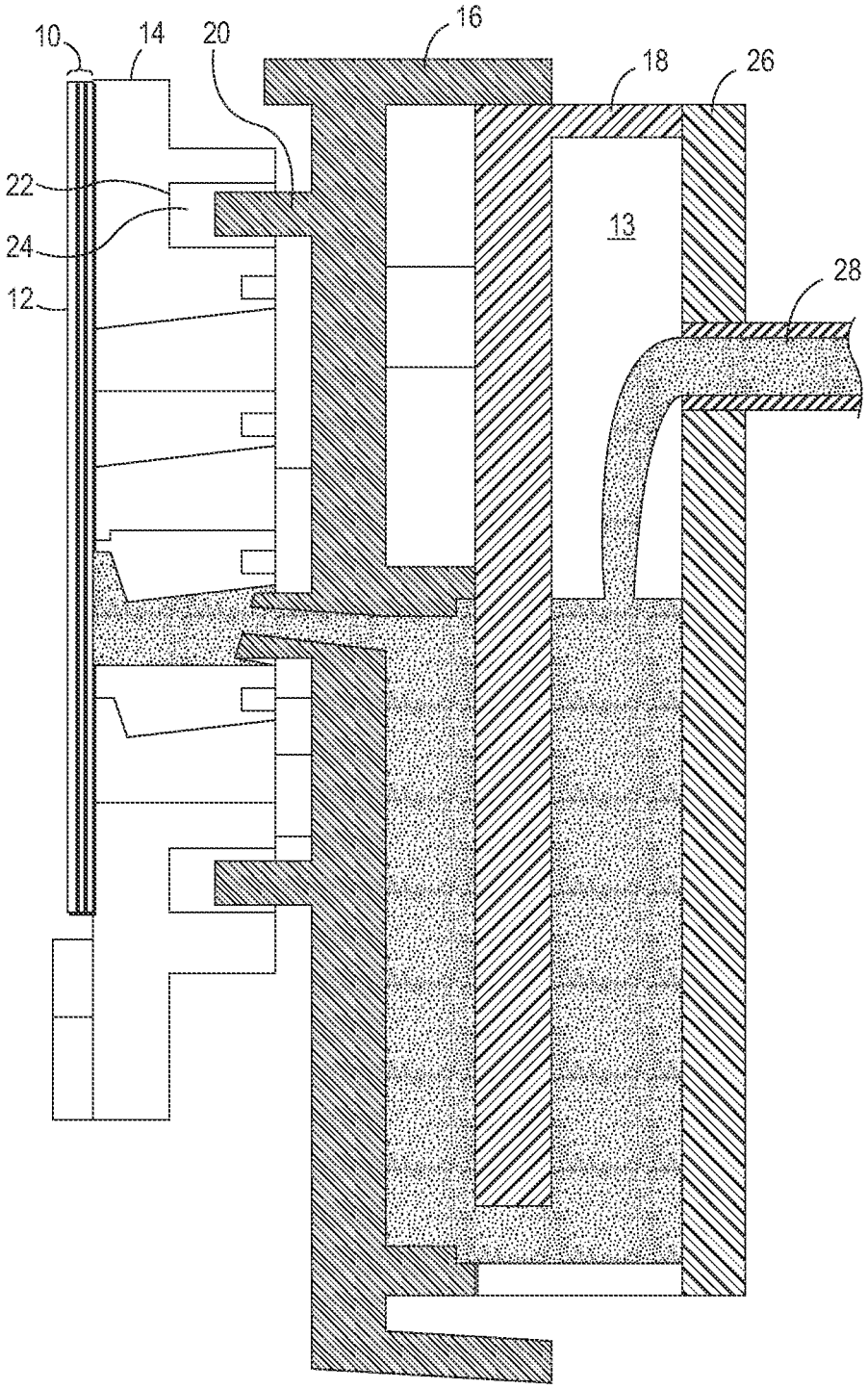
FIG. 1 shows an embodiment of a print system.

FIG. 1 shows a cross section side view of an embodiment of a jet stack and ink reservoir. The jet stack 10 may consist of several plates to form the various manifolds and ink paths, as well as a pressure chamber and the actuator that pushed ink out of the nozzle plate 12. The external manifold 14 receives ink from the reservoir 13, which in turn receives ink from an umbilical 28. The ink comes from the umbilical 28 and fills the reservoir 13. The reservoir is formed from a front plate 16, a tank plate 18 and back plate 26. The ink then travels from the reservoir 13 to the manifold plate 14 and ultimately to the jet stack 10, exiting the jet stack at nozzle plate 12.

In prior implementations, the jet stack is bonded to a surface of the external manifold. For purposes of the discussion here, the jet stack side of the external manifold will be referred to as the front side. The external manifold is pressed against the reservoir and compresses gaskets to form a seal. In these prior implementations, the manifold and reservoir surfaces in contact must meet strict flatness requirements. Each piece in the assembly must meet the production requirements in order for the assembly to meet the flatness requirements. Otherwise, the pieces become waste. This raises the costs of the resulting print head.

In the implementation of FIG. 1, the front plate 16 of the reservoir has protrusions such as 20 that mate with channels such as 22 on the back side of the external manifold. This in itself does not alleviate the production requirements. However, by using a curable adhesive 24 in these channels, the pieces can move within the joint before being cured to allow the assembly to meet the necessary production requirements.

In the embodiments discussed here, the jet stack has an external manifold, and the reservoir consists of front and back plates at either side of the reservoir tank plate. These elements of the particular embodiments are not necessarily needed to implement the invention as claimed here. The embodiments here provide examples of a fluid dispensing assembly using a jet stack coupled to an ink reservoir, with a merge joint somewhere between the jet stack and the reservoir.

Figure 2:
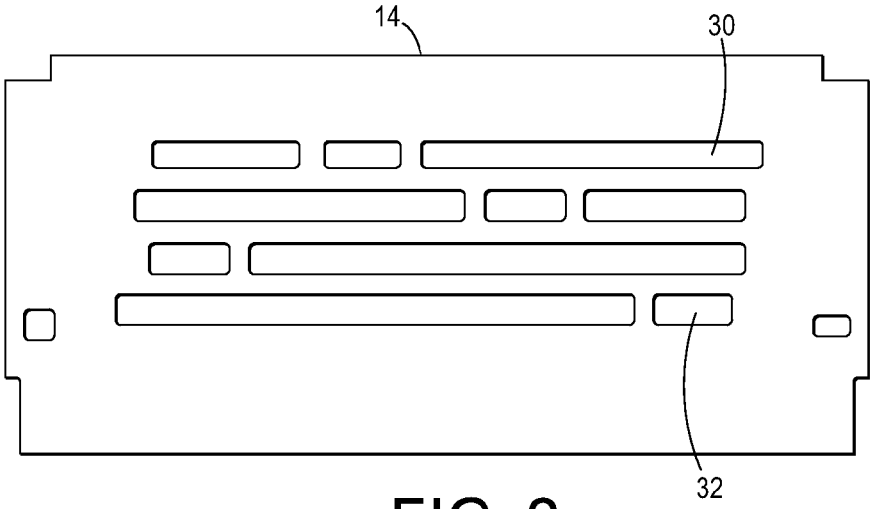
FIG. 2 shows a view of a first side of an external manifold of a jet stack.

FIG. 2 shows a front side view of the external manifold 14. This is the side that attaches to the jet stack. The manifold channels, such as 30 are open to the jet stack to allow the flow of ink. The external manifold plate has gaps or cut outs such as 32 that mate with corresponding protrusions on the front plate of the print reservoir.

Figure 3:
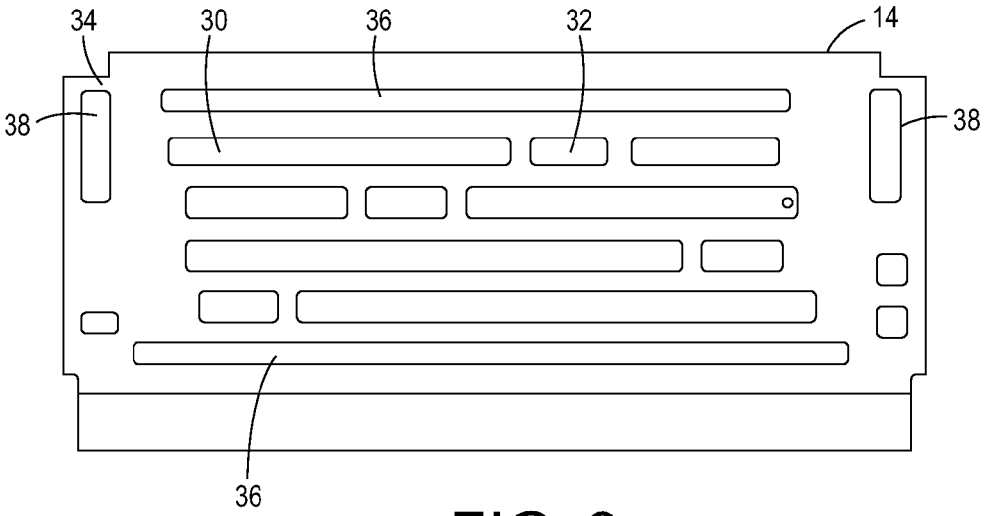
FIG. 3 shows a view of a second side of an external manifold of a jet stack.

FIG. 3 shows a back side of the external manifold 14. The manifolds on this side are closed to the reservoir, in this instance with a membrane or other film. The cut outs 32 pass through the plate completely. The back side of the external manifold has channels that eventually hold the adhesive. In this embodiment, the channels consist of horizontal channels 36 and vertical channels 38.

Figure 4:
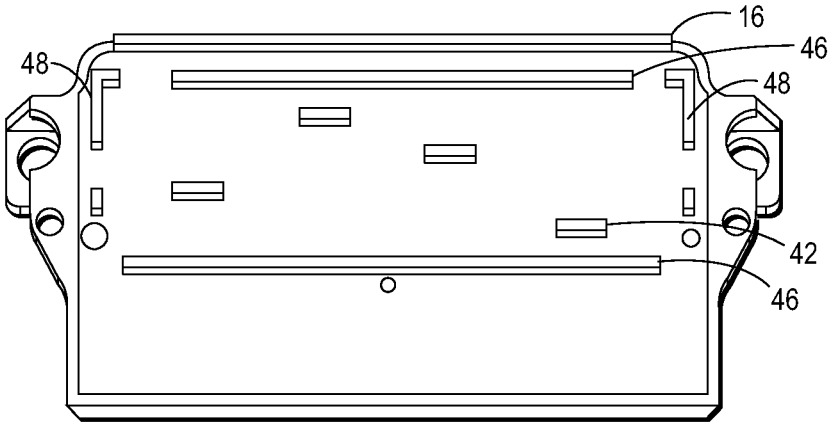
FIG. 4 shows a view of a first side of a front plate for a reservoir.

FIG. 4 shows a reservoir front plate 16 that caps off the front of the reservoir tank plate, and attaches to the external manifold. The plate 16 has protrusions that match up with the channels of the external manifold. Horizontal protrusions 46 and vertical protrusions 48 that match to the channels. The protrusions 42 match with the cut outs 32 on the external manifold. These allow the external manifold to mate with the reservoir.

Figure 5:
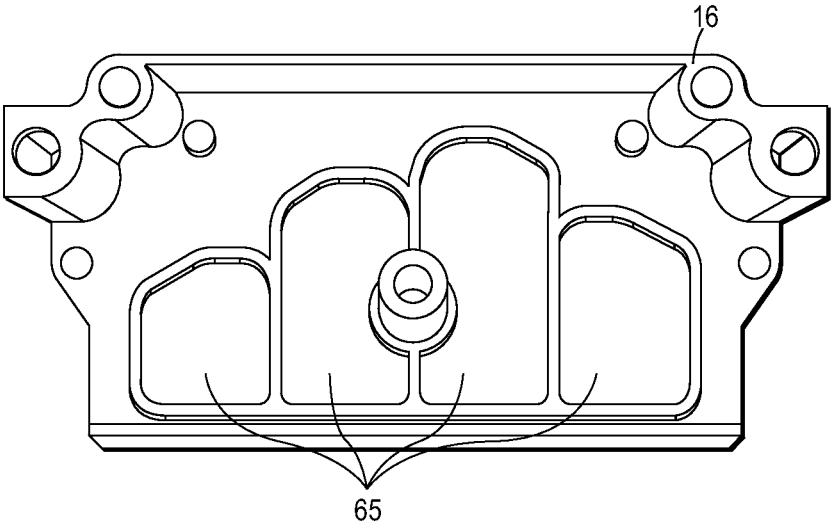
FIG. 5 shows a view of a second side of a front plate for a reservoir.
Figure 6:
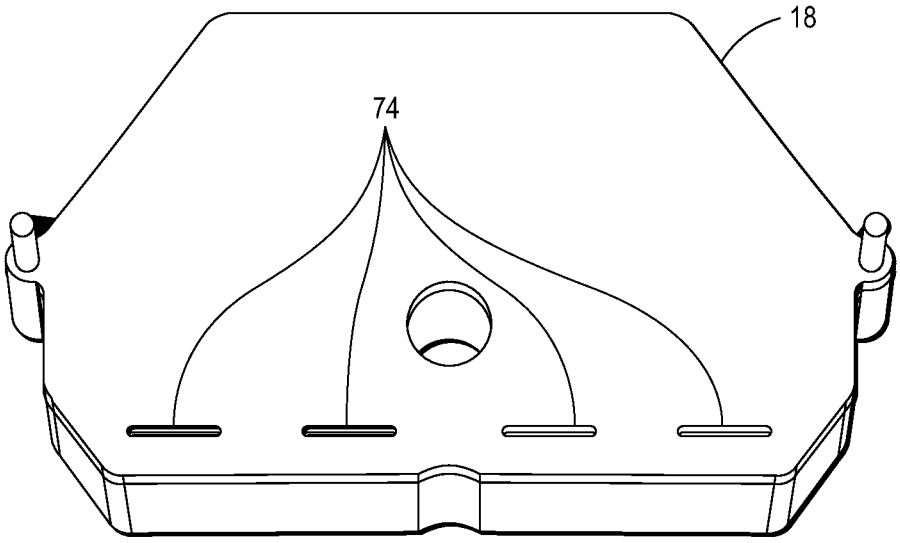
FIG. 6 shows a view of a first side of a back plate for a reservoir.

FIG. 5 shows a back side of the front plate 16. The back side has four vertical channels 65 that feed ink from the tank up to corresponding manifold channels. FIG. 6 shows an embodiment of a tank plate 18 of the ink reservoir. This plate 18, has ports 74, through which ink exits the tank and enters the channels on the back side of plate 16.

Figure 7:
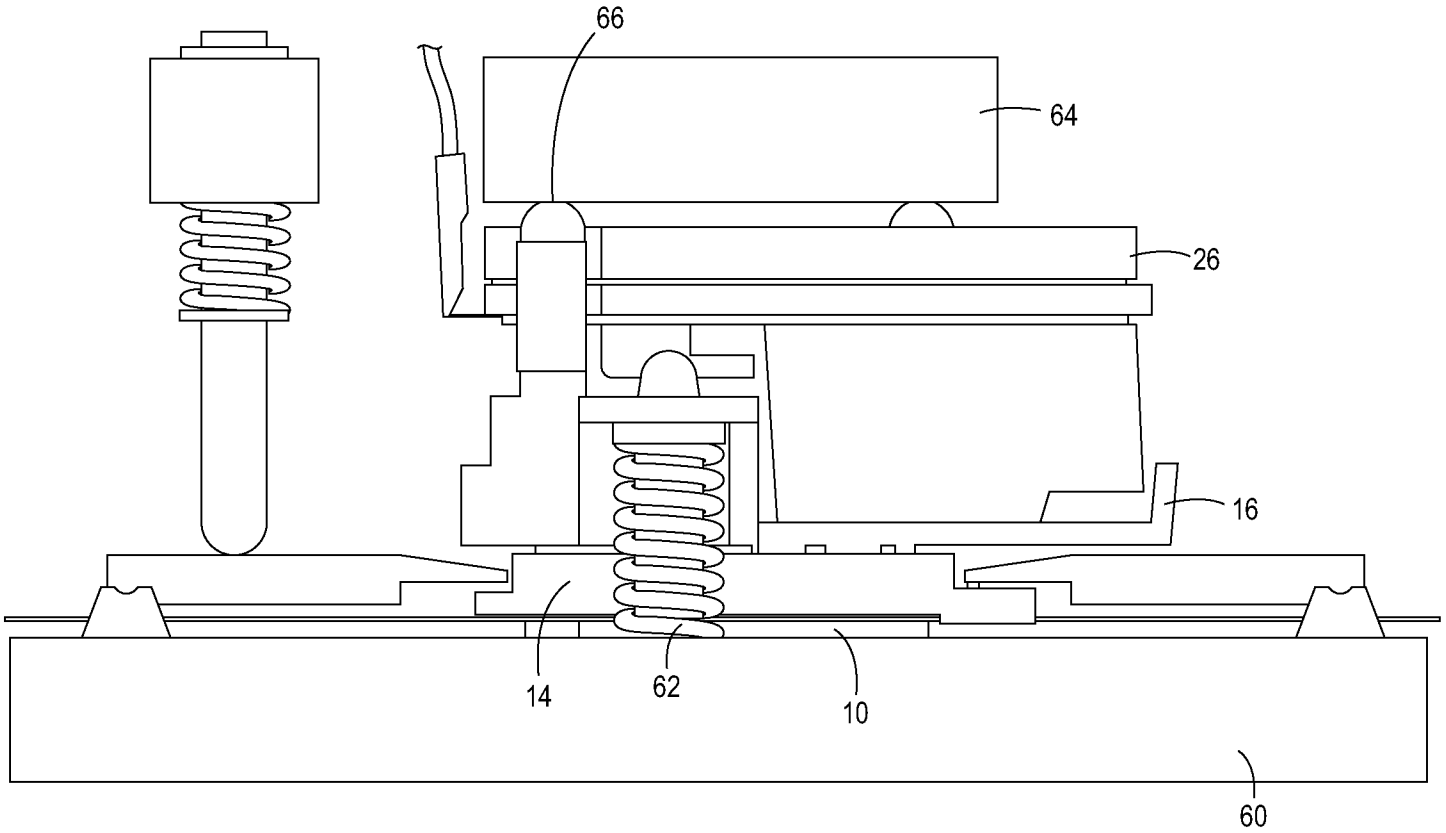
FIG. 7 shows an embodiment of a merge fixture.

The various plates are assembled into a print head assembly using a merge fixture that allows the plates to have the correct registration and conform to the needed flatness. FIG. 7 shows a side view of one embodiment of such a fixture. The jet stack 10 is held down flat against a flat base plate 60. The reservoir plates 16 and back plate 26 are being pushed up with the spring loaded pins against the upper plate 64. This plate is spaced off at a fixed distance from the base plate 60 which sets the distance from the datum features in the back of the reservoir 66 to the face plate of the jet stack 10.

The process first places and secures the jet stack 10 down against the flat base plate 60. It next dispenses the adhesive into the moat channels on the back side of the manifold plate 14. The reservoir is then placed onto the spring loaded pins such as 62, which locate the reservoir in x and y relative to the jet stack, but keep the reservoir above contacting the adhesive. Next is to clamp the upper plate which sets the z-distance from the back of the ball nose pins such as 66 of the reservoir to the front face plate of the jet stack. It is during this step that the protrusions on the front side of the reservoir are pressed into the adhesive to form a seal. This entire assembly fixture may then be heated up or otherwise treated to cure the adhesive. Heating the entire fixture may involve placing it into an oven. Alternatively, each piece could be heated using their own heaters. Curing may also occur by ultraviolet curing of a UV curable adhesive. However, there may be regions of the adhesive not reachable by the light.

The channels form a moat within which there is no contact between the reservoir and the manifold within the moat. Further, the adhesive fills the moat within the channels to create a structural bond between the reservoir and the jet stack, as well as to create a sealed ink path.

In the embodiments here, the plates are typically metal. However, the plates may be made of any suitable materials such as metal, ceramics, hardened polymer, etc. Similarly, the adhesive is any appropriate curable adhesive. The adhesive should have some measure of compliance to allow the pieces to adjust as they are merged and be curable with an appropriate level of hardness and able to withstand the thermal cycling that occurs during print head operation. Similarly, the reservoir does not necessarily need to have two plates but may consist of one piece or multiple pieces.

By using a fixture to set relative location of the jetstack to the reservoir, and an adhesive to secure this location, it is possible to relax individual part/sub-assembly tolerances, and eliminate gaskets and parts required to clamp the gaskets to form a seal. The adhesive being compliant to withstand relative motion due to thermal gradients, and still strong enough to create a structural bond and maintain a sealed fluid path between the reservoir and jetstack.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A print head, comprising:

an ink reservoir to hold ink, the reservoir having protrusions extending from a front side of the reservoir, each protrusion having a length along the front side of the reservoir, in which the length of at least one of the protrusions is nonparallel to the length of another one of the protrusions;

an external manifold coupled to the ink reservoir, the ink manifold having channels on a first surface that mate with the protrusions of the reservoir, leaving a space between the manifold and the protrusions within the channels; and an adhesive in the space within the channels to contact the protrusions and the manifold.

2. The print head of claim 1, further comprising a jet stack coupled to a second surface of the manifold.

3. The print head of claim 2, wherein the jet stack comprises a stack of metal plates.

4. The print head of claim 1, wherein the protrusions reside on a front plate of the ink reservoir.

5. The print head of claim 1, wherein the adhesive fills the space and wherein the protrusions do not directly contact the manifold.

6. The print head of claim 1, wherein the adhesive is a curable adhesive.

7. The print head of claim 1, wherein the channels define a moat and there is no contact between the reservoir and the manifold within the moat.

8. The print head of claim 1, wherein the ink reservoir consists of at least two plates.

* * * * *